US006293276B1

(12) United States Patent
Owens et al.

(10) Patent No.: US 6,293,276 B1
(45) Date of Patent: Sep. 25, 2001

(54) COOK GRILL TOP LID

(76) Inventors: Andrea Gonzella Owens, 6109 Elder St., Capitol Hts., MD (US) 20743; Richard Melvin Bowen, 10405 Buena Vista Ave., Lanham, MD (US) 20706

( * ) Notice: Subject to any disclaimer, the term of this patent is extended or adjusted under 35 U.S.C. 154(b) by 0 days.

(21) Appl. No.: 09/629,812

(22) Filed: Jul. 31, 2000

(51) Int. Cl.[7] ..... F24C 15/20

(52) U.S. Cl. ..... 126/299 D; 126/299 C; 126/42

(58) Field of Search ..... 126/299 D, 299 R, 126/299 F, 299 C, 300, 211, 217, 214 R, 214 D, 220, 21 R, 42; 454/49, 57, 61, 58, 56, 66, 51; 220/367.1, 369

(56) References Cited

U.S. PATENT DOCUMENTS

| | | | | |
|---|---|---|---|---|
| 587,766 | * | 8/1897 | Singewald | 126/299 C |
| 2,095,745 | * | 10/1937 | Hiatt | 126/299 C |
| 2,623,516 | * | 12/1952 | Salem | 126/299 C |
| 3,999,680 | * | 12/1976 | Cho | 220/369 |
| 4,436,023 | * | 3/1984 | Takahashi | 126/299 D |
| 4,609,126 | * | 9/1986 | Janda | 220/367.1 |
| 5,078,122 | * | 1/1992 | Kalenian | 126/299 R |
| 5,279,279 | * | 1/1994 | White | 126/299 D |
| 5,947,321 | * | 9/1999 | Vadney | 220/367.1 |

FOREIGN PATENT DOCUMENTS

| | | | | |
|---|---|---|---|---|
| 61-213511-A | * | 9/1986 | (JP) | 126/299 D |
| 62-288435-A | * | 12/1987 | (JP) | 126/299 D |

* cited by examiner

*Primary Examiner*—Ira S. Lazarus
*Assistant Examiner*—Josiah C. Cocks
(74) *Attorney, Agent, or Firm*—Clarence L. Albritton

(57) ABSTRACT

A removable diagonally ventilated hood with controlled ventilation provision and plural inlet and exhaust ports creating a downward fluid flow for use with a grill or burner section of a counter top stove that is provided with a suction exhaust inlet adjacent the burners or grill on the stove.

10 Claims, 4 Drawing Sheets

COOK GRILL TOP LID

FIELD OF THE INVENTION

The present invention relates to a hood device constructed and arranged to conserve energy when used in combination with a grill or counter-top stove with an exhaust by preventing the escapement of smoke and fumes while minimizing smoke, spatter and fume build up with a controllable cross ventilation system. The invention is constructed for use in combination with a grill or a counter top stove such as a JEN-AIR stove.

BACKGROUND OF THE INVENTION

In today's market, it is common place to see homes built that include a conventional downdraft cooking range.

The down-draft cooking range is a popular selling feature in today's housing market.

The cooking rage is provide with a suction exhaust which vents downwardly between adjacent cooking units. The cooking units may be electric, gas or any other well known heating source.

Today's modern kitchen usually includes an island-type cooking unit with electric or gas burners and suction means for removing smoke, grease-laden vapors, hot air and the like from the surrounding kitchen area. However, hoods or grill top lids designed for the notoriously famous JEN-AIR stove have not eliminated the release of grease-laden vapors which cause havoc by settling on luxurious ceramics, elegant hardwood floors and decorative walls and ceilings. Moreover, the release of smoke from a stove or from food under a hood on the stove has been known to trigger an alarm or smoke detector. This could turn a relaxed housewife into a nervous wreck. Additionally, in homes that are monitored at a central control station, a triggered alarm could needlessly set your municipal fire apparatus in motion.

In the prior art, the patent to Kalenian (U.S. Pat. No. 5,078,122) teaches the provision of an open-ended hood of u-shaped configuration with heat insulation means in the upper surface and below the handle member to decrease heat transfer to the handle.

The present invention is a hood with four depending sides with venting means. The venting means can be regulated to provide the maximum utilization of heat energy radiating from the heating unit or units enclosed by the hood.

The patent to White (U.S. Pat. No. 5,279,279) shows an adjustable u-shaped deflector device. The device can be adjusted in four directions. However, the device is unlike the present invention. The hood of the present invention utilizes the heat energy from a grill eye or broiler section of a counter-top stove, provided with an exhaust suction, to maximize the cooking potential of the section of the stove through the skilled manipulation of vents located in the hood.

The hood of the present invention maximizes the cooking potential of a stove section by regulating the influx of fresh air to the internal portion of the hood while the down draft of the exhaust suction opening in the stove removes smoke and various fluid contaminants entrained in the air moving through the hood to the exhaust suction opening.

BRIEF SUMMARY OF THE INVENTION

The hood of the present invention is structurally designed to solve the problems encountered by the well known counter top stove such as a JEN-AIR stove with an exhaust suction opening.

Counter top stoves with an exhaust means are normally operated without a hood or grill top lid. This type of open cooking has several drawbacks when operated in an enclosed environment such as the kitchen area of a modern house. Moreover, the scarcity of energy sources has taught us to be resourceful and to conserve energy that is used. The conservation of energy for economic reasons is equally applicable in this case. That is, due to the constant increase in the cost of energy, one is lead to devise means to conserve energy.

It is well known to provide a gas or electric counter top stove with a hood arranged in combination with a suction or exhaust opening in the counter top in an attempt to completely remove all undesirable fluids created by cooking units. It is well known that open hoods arranged in combination with suction or exhaust means in the prior art do not prevent the outflow of fluids such as hot air, steam smoke, grease-laden vapor and other gaseous contaminants into the air.

Steam, smoke, grease-laden vapor and other obnoxious fumes are known to form a deposit on the ceiling, walls and floors of adjacent enclosed areas such as kitchen and dining areas.

Slippery floors caused by grease-laden vapor are hazardous. Grease and smoke-laden walls create a constant repair problem; on the other hand smoke per se causes the needless activation of a nearby fire detector.

The present four-sided hood enclosure is further provided with controlled air inlet means for the purpose of preventing the above-indicated problems.

It is an object of the present invention to provide a hood for a suction-exhaust or down-draft type cooking range which improves the cooking efficiency by controlling the inlet air by adjustable inlet means and exhaust fluid by adjustable exhaust means while observing the internal hood area through a dome-shaped glass 10 pane or panes 3 located in the surface of the hood.

It is a further object of the present invention to improve the efficiency of a cooking hood when used with a suction-exhaust or down-draft type cooking range by controlling air influx to the internal portion of the hood by diagonally located adjustable inlet and exhaust means.

It is a further object of the present invention to improve the efficiency of a cooking hood when used with a suction-exhaust or downdraft type cooking range by controlling air influx to the internal portion of the hood by diagonally-located, adjustable inlet and exhaust means.

It is yet a further object of the invention to form the hood of a cast or welded body construction of rectangular configuration or dome-shaped top configuration.

It is still another object of the invention to use tempered steel, aluminum or stainless steel in the cast or welded hood body construction.

DETAILED DESCRIPTION OF THE INVENTION

Figure 1:
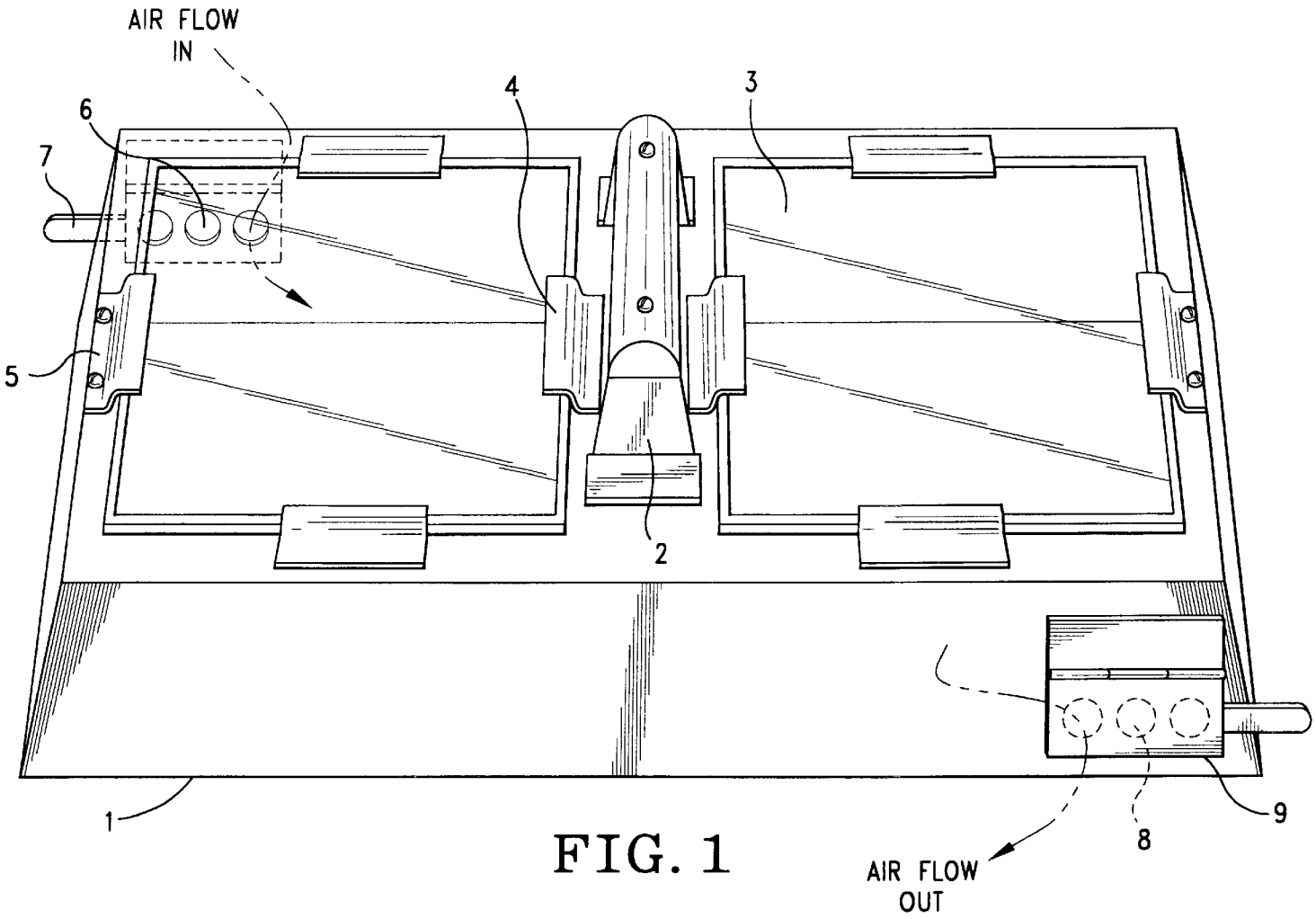
FIG. 1 is a perspective view of a removable hood usable in combination with a suction exhaust or down-draft type stove mounted in a counter top.
Figure 2:
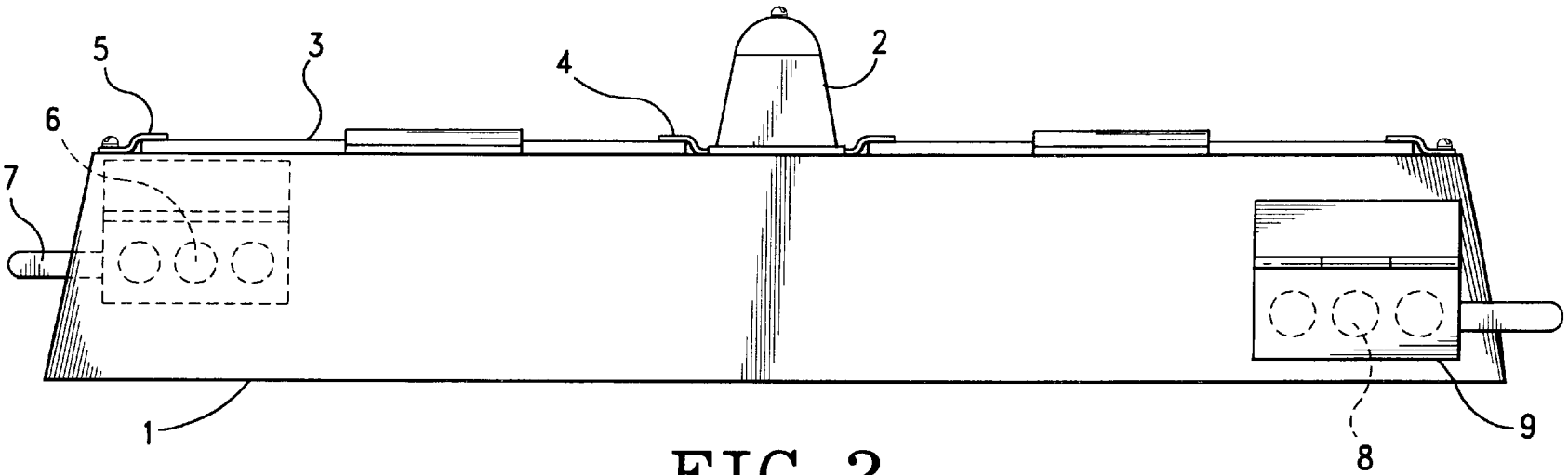
FIG. 2 is a side view of the hood shown in FIG. 1 with an upper port diagonally arranged with respect to a lower port.
Figure 3:
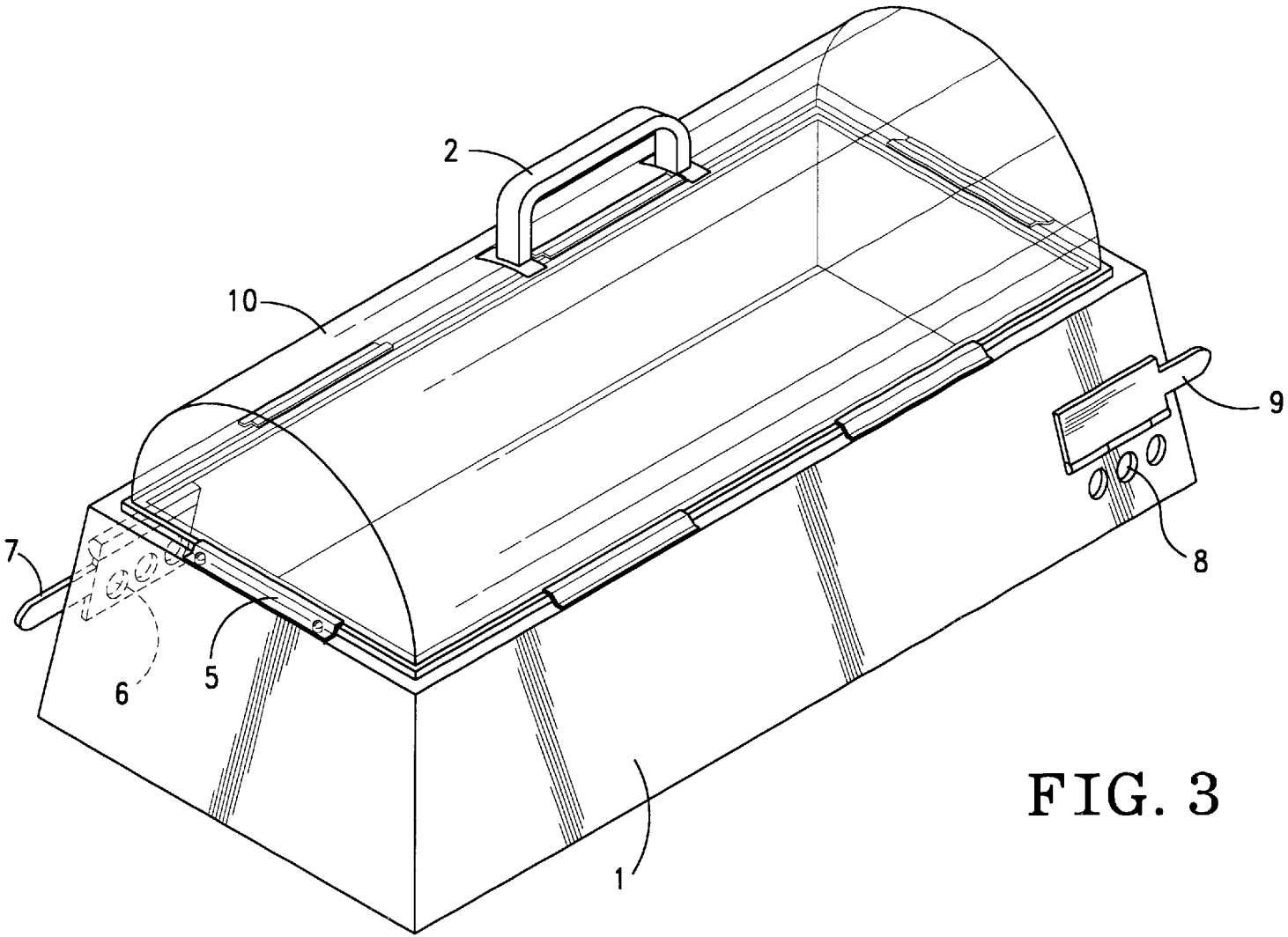
FIG. 3 is a perspective view of the hood where the top portion is dome-shaped.
Figure 4:
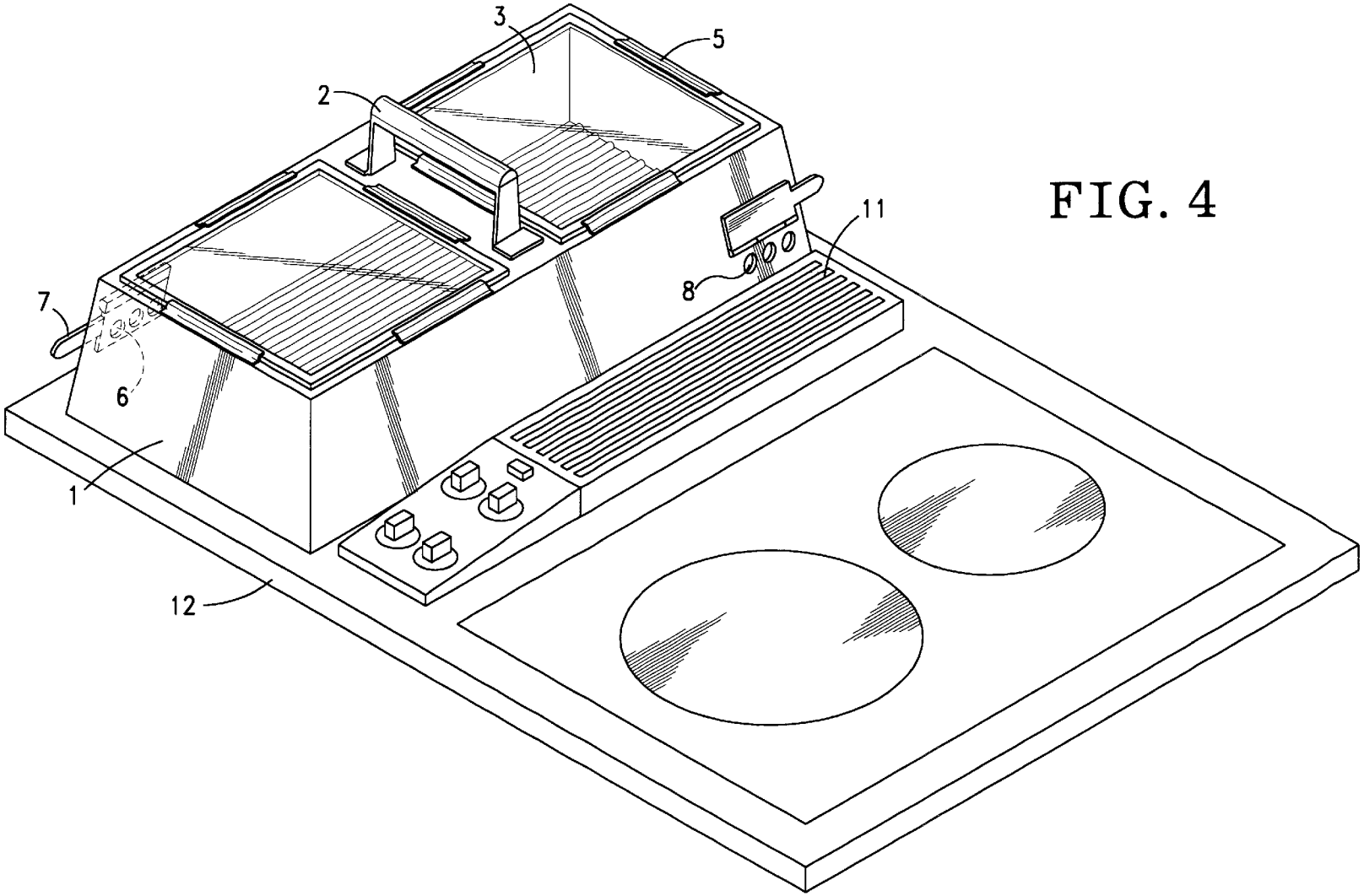
FIG. 4 is a perspective view of the hood and a counter top stove.

The present invention is an improved hood 1 for use with an in-house, suction exhaust or downdraft type counter top cooking device such as that sold under the JEN-AIR Trade Mark. The base of hood 1 is preferably rectangular in shape with a flat or dome-shaped top and is made of cast aluminum, painted tempered steel or stainless steel. The steels used may be sixteen gauge but other gauges may be used. Hood 1 is used to ensure a thorough cooking of meats and vegetables. Food requires less heat to cook by the careful manipulation of hinge-mounted air inlet port cover 7 located over a plurality of upper inlet port holes 6 and hinge-mounted exhaust port cover 9 located over a plurality of lower exhaust port holes 8.

The improved hood is further provided with tempered glass plates 3 in the top portion thereof for the purpose of observing food under the hood during the cooking process. The glass plates are secured in place by removable retainer members 4 and 5; moreover, hood 1 is further provided with manipulative handle means 2 with a wooden stock and screw retainer means.

The above noted hood 1 will hold heat around the enclosed food under the hood by slowing the convection currents moving over the food toward the suction exhaust port in a counter top stove. Less energy is used to cook food. Further, the hood can be completely ventilated for the removal of smoke by observing the interior of the hood through glass plates 3 by manipulating hingedly mounted upper inlet port cover 7 and lower exhaust port cover 9 on diagonally-arranged port holes 6 and 8, respectively, to allow air from the internal portion of the hood to flow to suction exhaust port 11 provided in counter top stove 12 in a diagonally, downward manner.

Further, with the closure of hingedly mounted inlet port cover 7 and exhaust port cover 9, the outflow of smoke or grease laden vapor is prevented. The provision of smoke in the air during cooking to trigger a smoke alarm or stain a wall, is prohibited. Moreover, the provision of grease laden vapor in the air to settle on floors ceilings or walls is controlled by the present invention. Absent a cooking operation, the inventive hood is further utilized as a protection member for a counter top grill or cook surface.

In this respect the hood is used to protect the surface from physical damage as well as spills, dust and other contaminants.

Other locations of a manipulative inlet air control means in the hood structure and other locations of glass plates or viewing means is considered to be within the scope of the invention.

We claim:

1. A removable ventilating hood usable in combination with a counter top stove defined by a surface area comprising plural burners or a grill member arranged for cooking and drown-draft suction means located adjacent said burners or gill member in fluid communication therewith, said hood comprising: a top wall, a centrally located handle attached to said top wall, said handle having a stock of insulation material, depending side walls attached to said top wall and forming a hood structure of rectangular configuration whereby said top wall forms a closed upper part of said hood and said attached depending side walls form an open-ended lower part, said rectangular configuration includes first and second long side walls in juxtaposition, said first wall having plural inlet ports located in an upper elevation thereof adjacent the top wall and said second wall having plural exhaust ports located in a lower elevation thereof adjacent an edge of the open-ended lower part thereby forming a downward fluid flow path from inlet to exhaust, the inlet and exhaust ports are further arranged in a diagonal relationship to create a diagonal fluid flow path, said inlet ports and said exhaust ports are provided with fluid flow regulation means for regulating said downward, diagonally directed fluid flow through the hood to remove smoke and other contaminants therefrom.

2. A removable ventilating hood usable in combination with a counter top stove defined by a surface area comprising a plurality of burners arranged for cooking and a down-draft suction means located adjacent said burners, said hood comprising: a top portion provided with an attached insulated handle member and heat-resistant tempered glass window means removably mounted in said top portion on opposite sides of said handle, depending side means attached to the top portion and defining a hood configuration with a closed top end and an open bottom end, said depending side means constructed with inlet ports in an upper portion thereof and exhaust ports arranged in a lower portion thereof, said inlet and exhaust ports are located opposite each other to remove fumes from the hood in a downward manner, said depending sides are further provided with adjustable fluid regulation means disposed over each said inlet and exhaust ports.

3. The hood as defined in claim 1 wherein the handle stock is made of wood.

4. The hood as defined in claim 1 wherein the top wall and said depending side walls are metal.

5. The hood as defined in claim 2 wherein the top portion is dome shaped.

6. The hood as defined in claim 1 wherein the top wall includes at least two removable mounted, heat-resistant, tempered glass panes located on opposite sides of said centrally located handle.

7. The hood of claim 4 wherein the metal is stainless steel.

8. The hood of claim 4 wherein the metal is aluminum.

9. The hood of claim 4 wherein the metal is tempered steel.

10. The hood of claim 2 wherein the adjustable fluid regulation means are hinge-mounted plates disposed over each said inlet and exhaust ports.

* * * * *